US010634095B2

(12) United States Patent
Nonaka et al.

(10) Patent No.: US 10,634,095 B2
(45) **Date of Patent: *Apr. 28, 2020**

(54) PORTABLE ENGINE WORKING MACHINE AND ROTARY CARBURETOR INCORPORATED THEREIN

(71) Applicant: Yamabiko Corporation, Tokyo (JP)

(72) Inventors: Takumi Nonaka, Tokyo (JP); Genichi Sato, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/159,739

(22) Filed: Oct. 15, 2018

(65) Prior Publication Data

US 2019/0048827 A1 Feb. 14, 2019

Related U.S. Application Data

(63) Continuation of application No. 15/826,817, filed on Nov. 30, 2017, now Pat. No. 10,202,942.

(30) Foreign Application Priority Data

Dec. 2, 2016 (JP) ..... 2016-235445

(51) Int. Cl.
*F02M 9/08* (2006.01)
*F02M 19/04* (2006.01)
(Continued)

(52) U.S. Cl.
CPC ..... *F02M 9/085* (2013.01); *F02D 9/16* (2013.01); *F02D 11/02* (2013.01);
(Continued)

(58) Field of Classification Search
CPC ..... F02M 9/085; F02M 9/12; F02M 9/06; F02M 9/08; F02M 19/0207; F02M 19/04;
(Continued)

(56) References Cited

U.S. PATENT DOCUMENTS 4,976,404 A 12/1990 Ichikawa et al.
5,033,433 A 7/1991 Churchill et al.
(Continued)

FOREIGN PATENT DOCUMENTS

DE 37 42 592 A1 6/1989
DE 10 2007 047 177 A1 4/2008
(Continued)

OTHER PUBLICATIONS

Extended European Search Report issued in corresponding European Patent Application No. 17 204 939.7 dated Feb. 8, 2018 (8 pages).

*Primary Examiner* — Mahmoud Gimie
(74) *Attorney, Agent, or Firm* — Kilyk & Bowersox, P.L.L.C.

(57) ABSTRACT

To improve responsiveness of fuel supply control, a rotary carburetor 100 has a nozzle 8 including a fuel discharge port 8*a* and a needle 10 disposed coaxially with the nozzle 8 and disposed with a portion inserted into the nozzle 8. The needle 10 can be displaced relative to the nozzle 8 to change an effective area of the fuel discharge port 8*a*. The rotary carburetor 100 has an electric motor 14 for displacing the needle 10 along an axis, and a drive mechanism component 12 interposed between the electric motor 14 and the needle 10 and converting a rotational movement of the electric motor into a linear movement.

13 Claims, 12 Drawing Sheets

(51) Int. Cl.

| | |
|---|---|
| ***F02D 9/16*** | (2006.01) |
| ***F02D 11/02*** | (2006.01) |
| ***F02M 19/02*** | (2006.01) |
| ***F02M 37/00*** | (2006.01) |
| ***F02M 9/12*** | (2006.01) |
| ***F02D 41/24*** | (2006.01) |
| ***F02D 35/00*** | (2006.01) |
| *F02B 63/02* | (2006.01) |
| *F02M 9/06* | (2006.01) |
| *F02M 17/10* | (2006.01) |
| *F02B 75/02* | (2006.01) |
| *F02D 41/04* | (2006.01) |

(52) U.S. Cl.
CPC ..... *F02D 35/0053* (2013.01); *F02D 41/2464* (2013.01); *F02M 9/12* (2013.01); *F02M 19/0207* (2013.01); *F02M 19/04* (2013.01); *F02M 37/007* (2013.01); *F02B 63/02* (2013.01); *F02B 2075/025* (2013.01); *F02D 41/045* (2013.01); *F02D 2400/06* (2013.01); *F02M 9/06* (2013.01); *F02M 17/10* (2013.01)

(58) Field of Classification Search
CPC ..... F02M 37/007; F02M 17/10; F02D 9/16; F02D 11/02; F02D 35/0053; F02D 41/2464; F02D 41/045; F02D 2400/06; F02B 63/02; F02B 2075/025
USPC ..... 123/438
See application file for complete search history.

(56) References Cited

U.S. PATENT DOCUMENTS

| | | | | |
|---|---|---|---|---|
| 5,249,773 | A | 10/1993 | Feld | |
| 5,942,160 | A | 8/1999 | Araki | |
| 7,261,281 | B2 | 8/2007 | Raffenberg | |
| 7,267,327 | B2 | 9/2007 | Sasaki et al. | |
| 8,166,931 | B2 | 5/2012 | Zwimpfer | |
| 8,833,316 | B2 | 9/2014 | Ono et al. | |
| 9,273,658 | B2 | 3/2016 | Kinnen et al. | |
| 2006/0086337 | A1 | 4/2006 | Nickel | |
| 2006/0207552 | A1 | 9/2006 | Kato | |
| 2008/0083394 | A1 | 4/2008 | Akita et al. | |
| 2009/0072417 | A1 | 3/2009 | Koizumi | |
| 2012/0043675 | A1 | 2/2012 | Suzuki | |
| 2013/0068974 | A1* | 3/2013 | Galka | F16K 37/0033 251/65 |
| 2014/0360467 | A1 | 12/2014 | Osburg et al. | |
| 2015/0102511 | A1 | 4/2015 | Yamazaki et al. | |
| 2015/0240747 | A1 | 8/2015 | Saito et al. | |
| 2016/0208685 | A1 | 7/2016 | Miyaki et al. | |
| 2016/0230704 | A1 | 8/2016 | Raffenberg et al. | |
| 2016/0356204 | A1 | 12/2016 | Tamura | |
| 2018/0156160 | A1 | 6/2018 | Nonaka et al. | |

FOREIGN PATENT DOCUMENTS

| | | | | |
|---|---|---|---|---|
| EP | 0 209 389 | A2 | | 1/1987 |
| GB | 2 213 961 | A | | 8/1989 |
| JP | 2001-073878 | A | | 3/2001 |
| JP | 2004019483 | A | * | 1/2004 |
| JP | 2005-146980 | A | | 6/2005 |
| JP | 2016-133075 | A | | 7/2016 |
| JP | 2016-142271 | A | | 8/2016 |

* cited by examiner

PORTABLE ENGINE WORKING MACHINE AND ROTARY CARBURETOR INCORPORATED THEREIN

This application is a continuation of U.S. patent application Ser. No. 15/826,817, filed Nov. 30, 2017, which claims priority to Japanese Patent Application No. 2016-235445, filed Dec. 2, 2016.

BACKGROUND OF THE INVENTION

The present invention relates to a portable engine working machine and a rotary carburetor incorporated therein.

Portable engine working machines specifically include chain saws, bush cutters, hedge trimmers, power blowers, etc. Portable engines are often equipped with carburetors.

Portable engine working machines are increasingly computerized, and an example thereof is a solenoid valve adopted for fuel control (Patent Documents 1, 2). In Patent Document 1, an engine including a solenoid valve for fuel control employs a combination of the solenoid valve and a butterfly carburetor. On the other hand, in Patent Document 2, an engine including a solenoid valve for fuel control employs a combination of the solenoid valve and a rotary carburetor.

The butterfly carburetor disclosed in Patent Document 1 has a discharge part facing an intra-carburetor air-fuel mixture passage, and fuel is sucked through this discharge part into an intake passage in the carburetor. Similarly, the rotary carburetor disclosed in Patent Document 2 has a nozzle projected into an intra-carburetor mixture passage, and fuel is sucked through this nozzle into an intake passage in the carburetor. Therefore, the fuel is supplied from the discharge part to the intake passage by utilizing a negative pressure of the intra-carburetor air-fuel mixture passage. The solenoid valve is disposed in an intra-carburetor fuel supply passage leading to the discharge part or the nozzle. It is noted that the rotary carburetor disclosed in Patent Document 2 does not include a needle inserted into a tip portion of the nozzle to control a fuel discharge amount. This is specified in paragraph [0038] of Patent Document 2.

As understood from Patent Documents 1 and 2, the rotary carburetor is employed as a carburetor incorporated in a portable engine working machine in addition to the butterfly carburetor. A basic structure of the rotary carburetor has a valve main body rotatable in a carburetor main body, a nozzle arranged coaxially with a rotation axis of the valve main body, and a needle inserted into the nozzle from a tip of the nozzle. An effective cross-sectional area of an intake passage is controlled by rotation of the valve main body. A fuel discharge amount is controlled by movement of the needle relative to the nozzle. In Patent Document 2, as described above, it is proposed that the needle is eliminated to interpose the solenoid valve instead in the intra-carburetor fuel supply passage leading to the needle.

An example of a rotary carburetor incorporated in a portable engine working machine is disclosed in Patent Document 3. In the rotary carburetor disclosed in Patent Document 3, a nozzle is stationary in a non-rotatable manner. The nozzle has a fuel discharge port at a tip thereof, and this fuel discharge port has a tapered shape in a circumferential direction. A needle is rotatable in conjunction with a valve main body and rotates around an axis together with the valve main body. The needle also has an opening vertically extending in a circumferential surface thereof. The valve main body and the needle described above are linked to a throttle lever operated by an operator for output adjustment such that the valve main body and the needle rotate around an axis.

When the operator operates the throttle lever, the valve main body and the needle rotate around an axis. This changes the effective cross-sectional area of the intake passage, i.e., a throttle valve opening degree. Additionally, the rotation of the needle relative to the stationary nozzle changes an area of an effective fuel outlet formed when the opening of the needle coincides with the fuel discharge port of the nozzle. Consequently, the rotary carburetor has the fuel discharge amount mechanically controlled together with the effective cross-sectional area of the intake passage (the throttle valve opening degree).

Patent Document 4 discloses a most popular rotary carburetor in the portable engine working machine. In the rotary carburetor of Patent Document 4, a nozzle is stationary in a non-rotatable manner. A rotatable valve main body is displaceable in the axial direction of the nozzle because of a support pin and a cam surface engaged therewith. A needle is integrated with the valve main body. The needle is displaced in the axial direction in conjunction with the axial rotation of the valve main body and the displacement in the axial direction associated therewith. The nozzle has a fuel discharge port on a circumferential surface of a tip portion thereof, and the effective opening area of the fuel discharge port is controlled by an advancing/retracting movement of the needle inserted into the tip of the nozzle. In other words, the fuel discharge amount is controlled by the relative advancing/retreating movement of the needle.

When the operator operates the throttle lever, the valve main body mechanically linked thereto rotates. An effective cross-sectional area of the intake passage in the carburetor, i.e., the throttle valve opening degree, changes according to the rotation of the valve main body. The rotation of the valve main body induces an axial displacement of the valve main body due to the cam surface. The axial displacement of the valve main body is accompanied by a relative displacement of the needle in the axial direction. On the other hand, since the nozzle is stationary, the effective opening area of the fuel discharge port of the nozzle circumferential surface varies according to the displacement of the nozzle in the axial direction.

Patent Document 5 discloses a rotary carburetor applied to a stratified scavenging engine. The stratified scavenging engine includes a scavenging passage communicating with a crank chamber and a combustion chamber, and this scavenging passage is charged with air. In a scavenging stroke, the air in the scavenging passage is first supplied to the combustion chamber, and an air-fuel mixture is then supplied from the crank chamber through the scavenging passage to the combustion chamber. The rotary carburetor disclosed in Patent Document 5 has two passages formed in a rotatable valve main body. One is a passage generating the air-fuel mixture, and the nozzle described above is arranged in this intra-carburetor air-fuel mixture passage. The other is a passage for supplying air to the scavenging passage.

PRIOR ART DOCUMENTS

Patent Document 1: Japanese Laid-Open Patent Publication No. 2016-133075 (counterpart US 2016/0208685 A1)

Patent Document 2: Japanese Laid-Open Patent Publication No. 2016-142271 (counterpart US 2016/0230704 A1)

Patent Document 3: Japanese Laid-Open Patent Publication No. 2001-73878

Patent Document 4: Japanese Laid-Open Patent Publication No. 2005-146980

Patent Document 5: U.S. Pat. No. 7,261,281 B2

In increasingly computerized portable engine working machines, the solenoid valve described above is effectively used for control of a fuel supply amount (Patent Documents 1, 2). This solenoid valve is interposed in a fuel supply passage in a carburetor. When the solenoid valve operates, an amount of fuel passing through the fuel supply passage is controlled. Consequently, this controlled amount of fuel further advances through the intra-carburetor fuel supply passage, and the fuel is supplied through the fuel discharge port to the intra-carburetor air-fuel mixture passage.

U.S. Pat. No. 9,273,658 B2 discloses that a magnet is incorporated in a fuel filter of a portable engine working machine to purify fuel with the magnet. As can immediately be understood from "purification of fuel by a magnet", the electromagnetic force of the solenoid valve attracts particles such as iron powder contained in the fuel. The particles accumulating in the solenoid valve cause partial or complete blockage of the intra-carburetor fuel supply passage.

As a result of studies for achieving further responsiveness, the present inventors focused attention on a combination of a nozzle of a rotary carburetor and a needle inserted into this nozzle. Specifically, the control of the fuel supply amount through relative displacement in the axial direction between the needle and the nozzle is provided by directly controlling a fuel discharge port. Focusing attention on this direct fuel control mechanism, the present inventors conceived the present invention.

SUMMARY OF THE INVENTION

An object of the present invention is to provide a portable engine working machine capable of improving responsiveness of fuel supply control and a rotary carburetor incorporated therein.

According to a viewpoint of the present invention, the technical problem described above is solved by providing a portable engine working machine comprising:

a rotary carburetor disposed in an intake passage of the portable engine working machine;

a rotatable valve main body included in the rotary carburetor, mechanically coupled to a throttle trigger operated by an operator, and rotated by an operation of the throttle trigger to change a throttle opening degree;

a nozzle disposed on an axis of the rotatable valve main body and including a fuel discharge port supplying a fuel to an intra-carburetor air-fuel mixture passage;

a needle disposed coaxially with the nozzle and disposed with a portion inserted into the nozzle, the needle being displaced relative to the nozzle to change an effective area of the fuel discharge port so as to control an amount of a fuel discharged from the fuel discharge port;

an electric motor for displacing the needle along an axis; and a drive mechanism component interposed between the electric motor and the needle and converting a rotational movement of the electric motor into a linear movement.

According to another viewpoint of the present invention, the technical problem described above is solved by providing a rotary carburetor disposed in an intake passage of a portable engine working machine comprising:

a rotatable valve main body mechanically coupled to a throttle trigger operated by an operator, the rotatable valve main body rotated by an operation of the throttle trigger to change a throttle opening degree;

a nozzle disposed on an axis of the rotatable valve main body and including a fuel discharge port supplying a fuel to an intra-carburetor air-fuel mixture passage;

a needle disposed coaxially with the nozzle and disposed with a portion inserted into the nozzle, the needle being displaced relative to the nozzle to change an effective area of the fuel discharge port so as to control an amount of a fuel discharged from the fuel discharge port;

an electric motor for displacing the needle along an axis; and a drive mechanism component interposed between the electric motor and the needle and converting a rotational movement of the electric motor into a linear movement.

Since the amount of the fuel discharged from the fuel discharge port is directly controlled by the needle inserted into the nozzle, the present invention not only provides excellent responsiveness but also has no risk that iron powder etc. contained in fuel is locally accumulated in an intra-carburetor fuel supply passage due to an electromagnetic force as in the solenoid valve.

Effects and further objects of the present invention will become apparent from the following detailed description of preferred embodiments of the present invention.

DETAILED DESCRIPTION OF THE PRESENT INVENTION

Preferred embodiments of the present invention will now be described with reference to the accompanying drawings. A rotary carburetor of the embodiments is incorporated in a portable engine working machine. Typical examples of the portable engine working machine include chain saws and bush cutters. Although a two-stroke engine is a typical example of an engine, the engine may obviously be a four-cycle engine.

Figure 1:
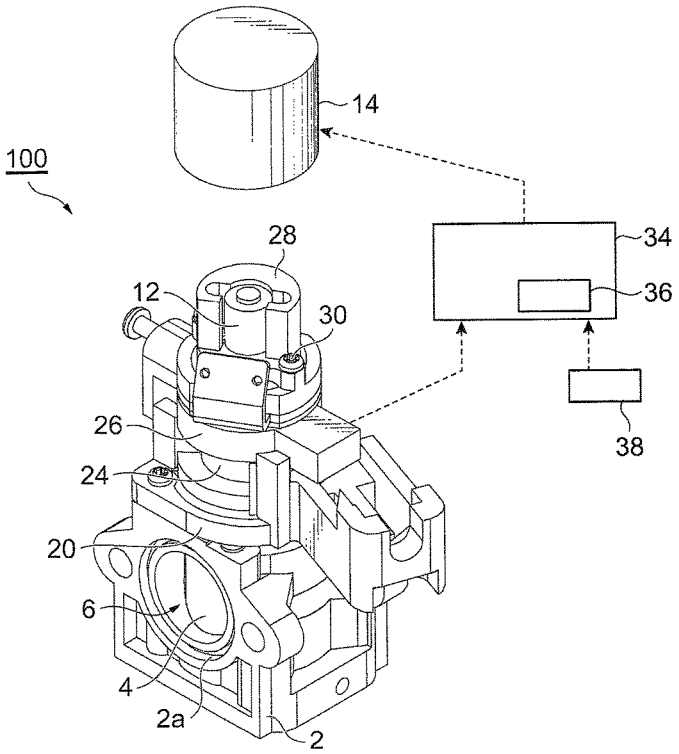
FIG. 1 shows a perspective view of a rotary carburetor mounted on an engine working machine of a first embodiment.
Figure 2:
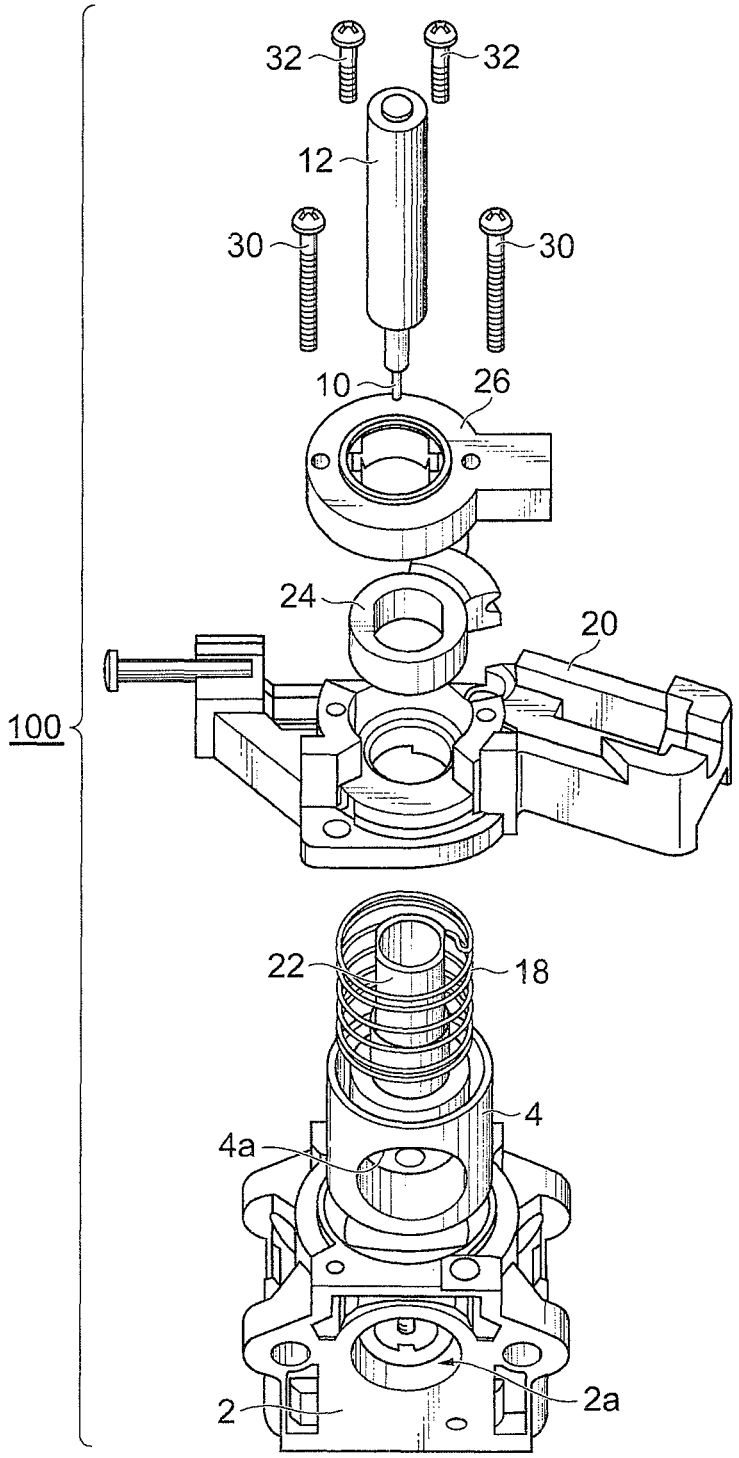
FIG. 2 shows an exploded perspective view of the rotary carburetor of FIG. 1.
Figure 3:
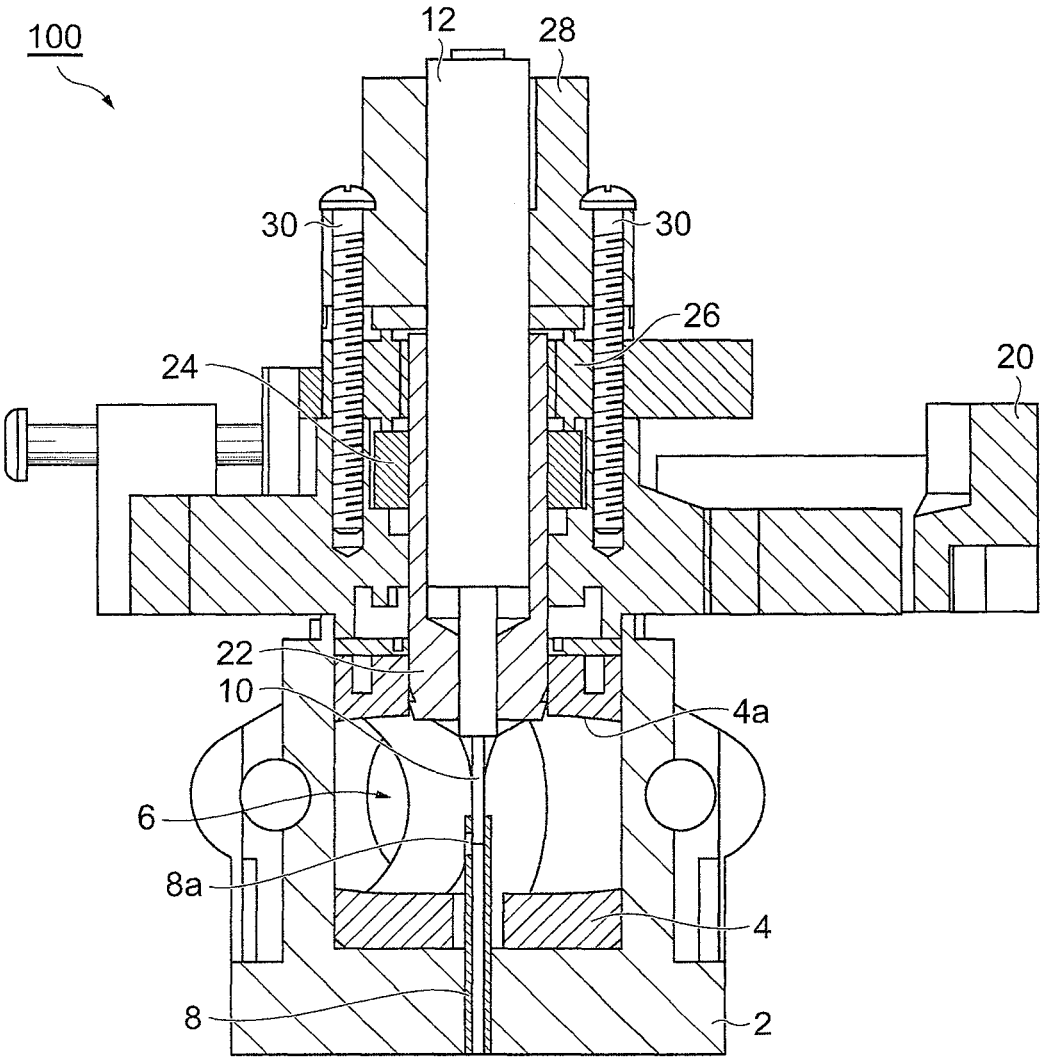
FIG. 3 shows a longitudinal sectional view of the rotary carburetor of FIG. 1.

First Embodiment (FIGS. 1 to 3)

FIGS. 1 to 3 show a rotary carburetor mounted on a portable engine working machine according to a first embodiment of the present invention. FIG. 1 is a perspective view. FIG. 2 is an exploded perspective view. FIG. 3 is a longitudinal sectional view.

Referring to FIGS. 1 to 3, a shown rotary carburetor 100 has a carburetor main body 2, and a columnar valve main body 4 is received in an axis-rotatable manner in the carburetor main body 2. This valve main body 4 is not displaced in the axial direction.

As in the prior art, the carburetor main body 2 has two openings 2*a* opposed to each other. The cylindrical valve main body 4 has one through-hole 4*a*. This through-hole 4*a* forms an intra-carburetor passage 6 together with the two openings 2*a*, and an air-fuel mixture is generated in the intra-carburetor passage 6. Therefore, this intra-carburetor passage 6 will be referred to as an "intra-carburetor air-fuel mixture passage" in the following description.

The axial rotation of the cylindrical valve main body 4 controls an effective passage cross-sectional area of the intra-carburetor air-fuel mixture passage 6, i.e., a throttle valve opening degree as in the prior art.

The rotary carburetor 100 has a nozzle 8 fixed to the carburetor main body 2 as in the prior art (FIG. 3). The nozzle 8 extends upward on the axis of the valve main body 4 and penetrates the valve main body 4 into the carburetor air-fuel mixture passage 6. Therefore, the valve main body 4 is rotatable around the stationary nozzle 8. A tip portion of the nozzle 8 is provided with a fuel discharge port 8*a* in a circumferential surface thereof (FIG. 3) and, when fuel is discharged from the fuel discharge port 8*a*, the air-fuel mixture is generated in the intra-carburetor air-fuel mixture passage 6 and this air-fuel mixture is supplied to a crank chamber as in the prior art.

A portion of a needle 10 is inserted in the nozzle 8 as in the prior art. Therefore, the needle 10 is arranged on the axis of the valve main body 4. In other words, the needle 10 is coaxial with the nozzle 8. The effective area of the fuel discharge port 8*a* is defined by a tip portion of the needle 10, and the needle 10 is vertically moved to control an amount of fuel supplied through the fuel discharge port 8*a* to the intra-carburetor air-fuel mixture passage 6.

The needle 10 is provided with a drive mechanism component 12 vertically displacing the needle 10. The drive mechanism component 12 includes a conversion mechanism using, for example, a screw for converting a rotational movement to a linear movement. An electric motor 14 (FIG. 1) is coupled to the drive mechanism component 12. A typical example of the electric motor is a stepping motor.

Reference numeral 18 shown in FIG. 2 denotes a return spring, and reference numeral 20 denotes a cover member. The carburetor main body 2 receiving the valve main body 4 is closed by the cover member 20. The return spring 18 is interposed between the cover member 20 and the valve main body 4.

The valve main body 4 has a cylindrical throttle shaft 22 extending upward, and this throttle shaft 22 extends upward through the cover member 20. The throttle shaft 22 is rotatable relative to the cover member 20. The outer circumferential surface of the throttle shaft 22 has a non-circular irregular cross-sectional shape (FIG. 2).

A throttle lever 24 and a position sensor 26 are arranged around the throttle shaft 22. A case of the position sensor 26 has a ring shape and is arranged coaxially with the throttle shaft 22. The case of the position sensor 26 has a shape surrounding at least a portion of the circumference of the throttle shaft 22 and is fixed to the cover member 20 by a fixing member 28 (FIG. 3) surrounding an upper end portion of the drive mechanism component 12, and first bolts 30. Although the fixing member 28 is not shown in FIG. 2, the drive mechanism component 12 is fastened to the fixing member 28 by second bolts 32 and the drive mechanism component 12 is received in the hollow throttle shaft 22.

In the throttle lever 24, an opening receiving the throttle shaft 22 has an irregular shape complementary to the throttle shaft 22, so that the throttle lever 24 is integrated with the throttle shaft 22, i.e., the valve main body 4. Therefore, the throttle lever 24 is coupled to the throttle shaft 22 in a relatively non-rotatable manner. The throttle lever 24 is mechanically linked through a wire (indicated by "W" in FIG. 4) to a throttle trigger (indicated by "Tt" in FIG. 4) operated by an operator. When the operator operates the throttle trigger Tt, the movement of the throttle lever 24 interlocking with this operation causes the valve main body 4 to rotate around an axis so as to control the passage effective cross-sectional area of the intra-carburetor air-fuel mixture passage 6, i.e., the throttle valve opening degree.

The ring-shaped position sensor 26 arranged around the throttle shaft 22 can detect the rotational position of the throttle lever 24. Therefore, the throttle valve opening degree of the rotary carburetor 100 can linearly be detected by the position sensor 26. In FIG. 1, reference numeral 34 denotes a control unit with a memory 36, and reference numeral 38 denotes a sensor for detecting a rotation speed of an engine.

The throttle valve opening degree detected by the position sensor 26 is applied to the control of the fuel supply amount together with the engine rotation speed, for example. Specifically, the position sensor 26 can sense that the valve main body 4 is (i) located at an idle position, (ii) located at a fully open position, and (iii) located at a partial position, and (iv) a rotational speed of the valve main body 4, i.e., a throttle valve opening degree change speed, (v) a rotation amount of the valve main body 4, i.e., a throttle valve opening degree change amount, etc. These are applied to the control unit 34 to control the electric motor 14 (FIG. 1), i.e., the needle 10, so that the effective opening area of the fuel discharge port 8*a* of the nozzle 8 can directly be controlled. Thus, the optimization of fuel supply can be achieved with excellent responsiveness.

This optimization of fuel supply is achieved without using a solenoid valve as in the prior art and therefore has no risk of causing the problem of using the solenoid valve, i.e., the problem that iron powder in fuel is accumulated and consequently clogs an intra-carburetor fuel passage.

The position sensor 26 only needs to detect the rotation of the throttle shaft 22 within the rotational range of the valve main body 4 and therefore can have a shape defined by this detection range; however, in the case of the position sensor 26 having a ring shape, this sensor is easily arranged around the throttle shaft 22 of the valve main body 4, so that the rotary carburetor 100 including the position sensor 26 can be made compact.

Figure 4:
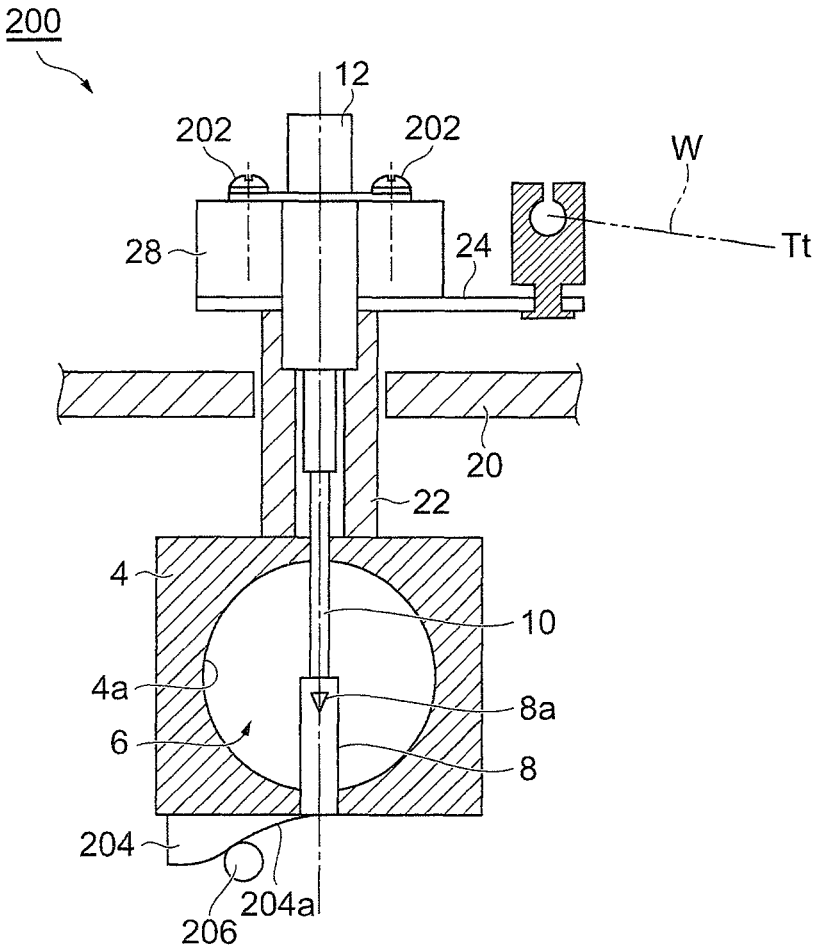
FIG. 4 shows a schematic view for explaining a structure of a rotary carburetor mounted on an engine working machine of a second embodiment.

Second Embodiment (FIG. 4)

FIG. 4 shows a rotary carburetor 200 mounted on a portable engine working machine of a second embodiment. In the description of the rotary carburetor 200 shown in FIG. 4, the same elements as those of the first-mentioned rotary carburetor 100 are denoted by the same reference numerals. FIG. 4 is a view for explaining a main part of the rotary carburetor 200. The main part of the rotary carburetor 200 will be described with reference to FIG. 4. Although not shown in FIG. 4, the ring-shaped position sensor 26 described in the first embodiment may be disposed in the rotary carburetor 200.

The valve main body 4 received in the carburetor main body 2 described with reference to FIG. 1 etc. rotates around an axis and is vertically displaced along the axis. Therefore, the rotary carburetor 200 has a vertical drive mechanism vertically moving the valve main body 4. The vertical displacement of the valve main body 4 is accompanied by a vertical motion of the needle 10. In other words, the valve main body 4 and the needle 10 rotate together and are vertically displaced together. On the other hand, the nozzle 8 is fixed to the carburetor main body 2 and therefore is not vertically displaced. The rotation of the valve main body 4 is induced by the throttle lever 24 mechanically interlocking through the wire W with an operator's operation of the throttle trigger Tt. The rotation of the valve main body 4 is accompanied by a vertical motion thereof and is also accompanied by a vertical motion of the needle 10. The vertical displacement of the needle 10 changes the effective area of the fuel discharge port 8*a* opened in the circumferential surface of the nozzle 8. Specific description will hereinafter be made with reference to FIG. 4.

Referring to FIG. 4, the valve main body 4 has a cam 204 on an end face thereof, which is a lower end surface in this embodiment, and a cam surface 204*a* of the cam 204 is engaged with a support pin 206 fixed to the carburetor main body 2. When the valve main body 4 rotates around the axis, the cam 204 vertically displaces the valve main body 4. This vertical drive mechanism is the same as the rotary carburetor of Patent Document 4 cited above.

The cylindrical throttle shaft 22 extending upward from the valve main body 4 extends upward through the cover member 20 and has an upper end fixed to the throttle lever 24.

The rotary carburetor 200 of the second embodiment includes the needle 10 and the drive mechanism component 12 vertically driving the needle 10 with the electric motor 14 (FIG. 1), and the drive mechanism component 12 has an upper end portion fixed to the throttle lever 24 by the fixing member 28 and bolts 202.

When the operator operates the throttle trigger Tt, this operation is transmitted through the wire W to the throttle lever 24, and the throttle lever 24 rotates. When the throttle lever 24 rotates, the throttle shaft 22 rotates. Therefore, the valve main body 4 rotates. This causes a change in the passage effective cross-sectional area of the intra-carburetor air-fuel mixture passage 6 (FIG. 1), i.e., the throttle opening degree.

When the valve main body 4 rotates, the valve main body 4 is displaced upward or downward by the cam 204. This displacement is transmitted through the throttle shaft 22 and the throttle lever 24 to the drive mechanism component 12 and the needle 10 is displaced upward or downward together with the drive mechanism component 12. On the other hand, since the nozzle 8 is fixed to the carburetor main body 2 (FIG. 3), the effective area of the fuel discharge port 8*a* of the nozzle 8 changes due to the displacement of the needle 10.

In the rotary carburetor 200 shown in FIG. 4, the effective area of the fuel discharge port 8*a* is mechanically controlled in conjunction with the operator's trigger operation. This can be used as a basis for applying electronic control using the electric motor 14. Therefore, a control amount of the optimum control of the fuel supply amount using the electric motor 14 has a corrective meaning, so that a small control amount thereof is sufficient. When the control amount is smaller, the responsiveness of the control becomes better, and consequently, the responsiveness of the optimum control of the fuel supply amount can further be improved.

Zero-Point Adjustment (FIGS. 5 to 11):

By adjusting the origin of upward or downward displacement of the needle 10 based on the rotation of the electric motor (stepping motor) 14, i.e., adjusting a zero-point, the accuracy of the fuel supply amount control can be ensured. This zero-point adjustment is performed by using a predetermined reference plane included in the rotary carburetors 100, 200 and the electric motor 14. Three examples of the zero-point adjustment will be described with reference to FIGS. 5 to 7.

Figure 5:
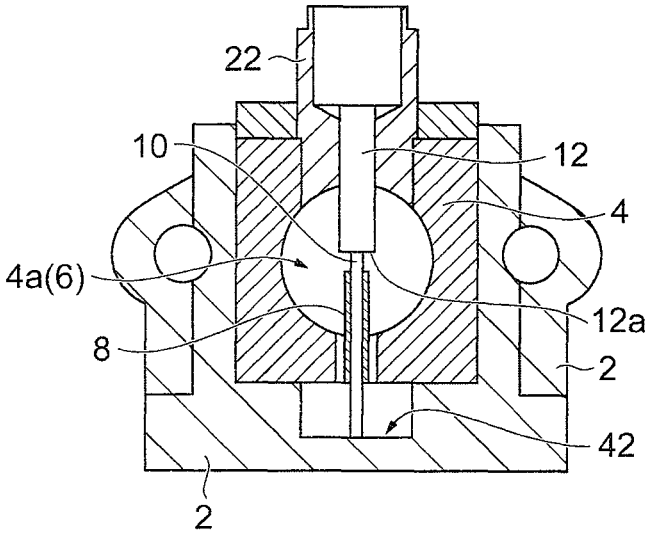
FIG. 5 shows a view for explaining one method of zero-point adjustment of a motor and a zero-point is defined as a point at which a needle collides with a plane serving as a reference of a carburetor main body when the needle is extended.

FIG. 5 is a view for explaining one example of the zero-point adjustment when the carburetor main body 2 has a concave portion under the needle 10 and a bottom surface 42 of this concave portion is used as the reference plane. Specifically, the zero-point adjustment is performed by defining as the origin, i.e., the zero-point, a point at which the needle 10 collides with the bottom surface 42 of the concave portion and causes the stepping motor 14 to step out when the needle 10 is deviated from a displacement range of control of the needle 10, i.e., a movable control range of the needle 10, and further displaced downward.

Figure 6:
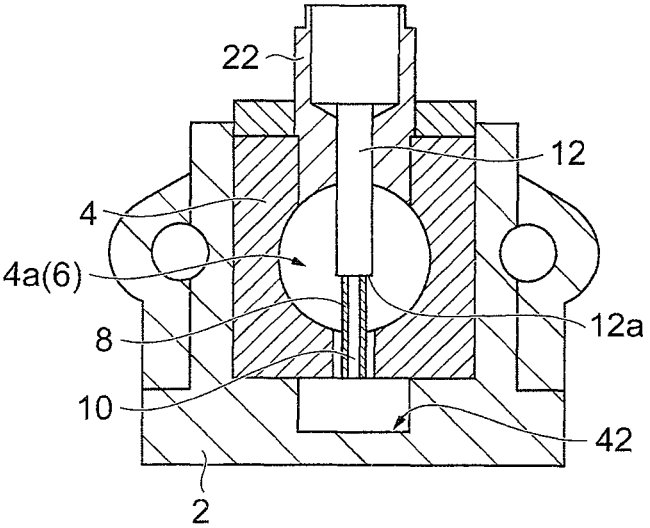
FIG. 6 shows a view for explaining another method of zero-point adjustment of a motor and a zero-point is defined as a point at which a step portion between a drive mechanism component and the needle collides with an end surface of a nozzle.

FIG. 6 shows another example in which the drive mechanism component 12 is deviated from a movable control range of the drive mechanism component 12 and further displaced downward to cause a step portion 12*a* between the needle 10 and the drive mechanism component 12 to collide with an upper end surface of the nozzle 8. Therefore, FIG. 6 shows an example of the zero-point adjustment performed by defining as the origin, i.e., the zero-point, a point at which the step portion 12*a* abuts on the nozzle 8. Thus, the example of FIG. 6 is an example in which the upper end surface of the nozzle 8 is used as the reference plane.

Figure 7:
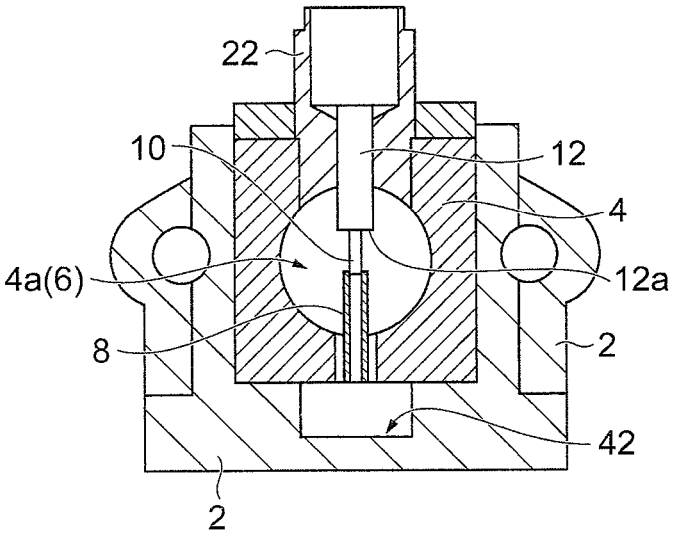
FIG. 7 shows a view for explaining the other method of zero-point adjustment of a motor and a zero-point is defined as a limit value, i.e., a point at which the needle can no longer be raised, when the needle is continuously raised by an electric motor.

FIG. 7 shows the other example in which the zero-point is set as a point at which the needle 10 can no longer move upward, i.e., a point at which the needle 10 can no longer be retracted, when the needle 10 is displaced (retracted) upward to the maximum. Specifically, in FIG. 7, the zero-point adjustment is performed by defining as the origin, i.e., the zero-point, a point at which the needle 10 can no longer move upward when the needle 10 is deviated from the movable control range of the needle 10 and further displaced upward.

The zero-point adjustment is preferably performed when the operation state of the engine is a predetermined operation state. The examples of FIGS. 5 and 6 include a step of completely closing the fuel discharge port 8*a* with the needle 10 and are therefore suitably performed at the time of deceleration. The example of FIG. 7 includes a step of completely opening the fuel discharge port 8*a* and is therefore suitably performed at the time of acceleration.

Figure 8:
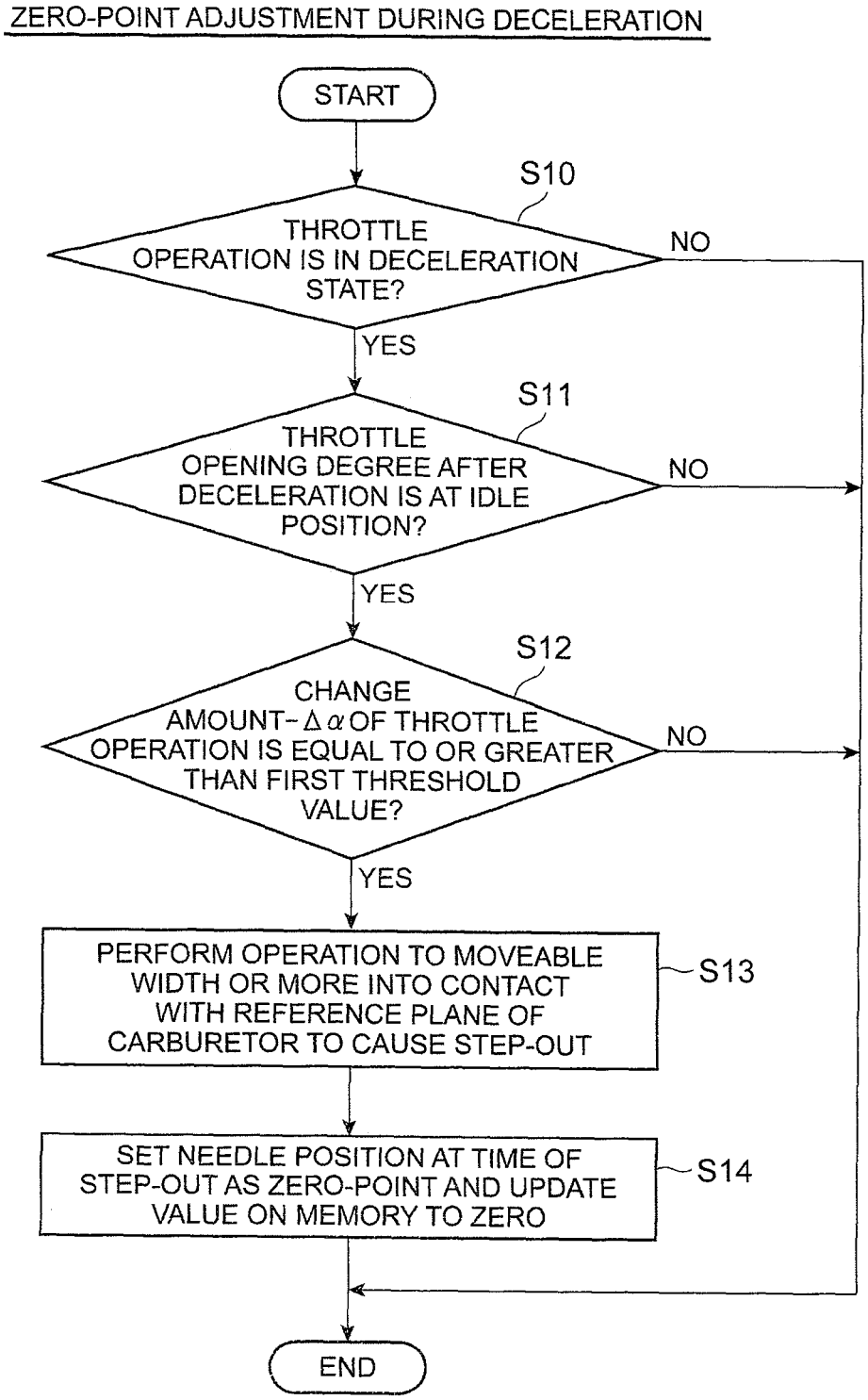
FIG. 8 shows a flowchart for explaining one zero-point adjustment method.
Figure 9:
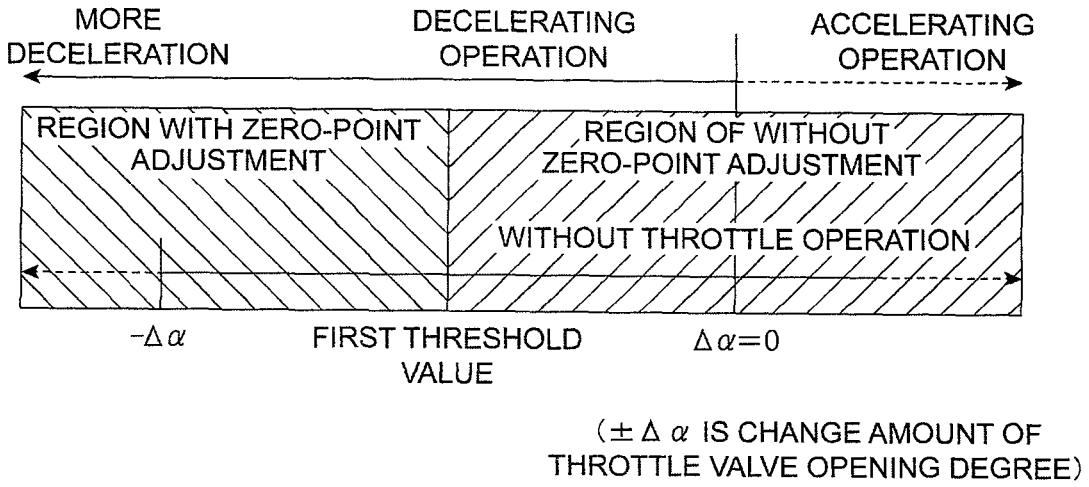
FIG. 9 shows a diagram for explaining the zero-point adjustment shown in FIG. 8 performed during deceleration.

The zero-point adjustment during deceleration will be described with reference to FIGS. 8 and 9. In FIG. 8, it is determined at step S10 whether a throttle operation is in a deceleration state. This determination is made based on the output of the position sensor 26. At next step S11, it is determined whether the throttle opening degree is at the idle position. This determination is also made based on the output of the position sensor 26. At next step S12, it is determined whether a change amount $-\Delta\alpha$ of the throttle operation is equal to or greater than a first threshold value. If all the steps of steps S10 to S12 are YES, it is determined that the current operation state corresponds to a region with zero-point adjustment shown in FIG. 9, and the zero-point adjustment is performed at step S13. This zero-point adjustment is performed by the method described with reference to FIG. 5 or 6. For example, in the example of FIG. 5, the needle 10 is displaced downward to collide with the bottom surface 42 of the concave portion. At next step S14, the position of the needle 10 abutting on the bottom surface 42 is set as the zero-point, and this value on the memory 36 (FIG. 1) is updated to zero.

Figure 10:
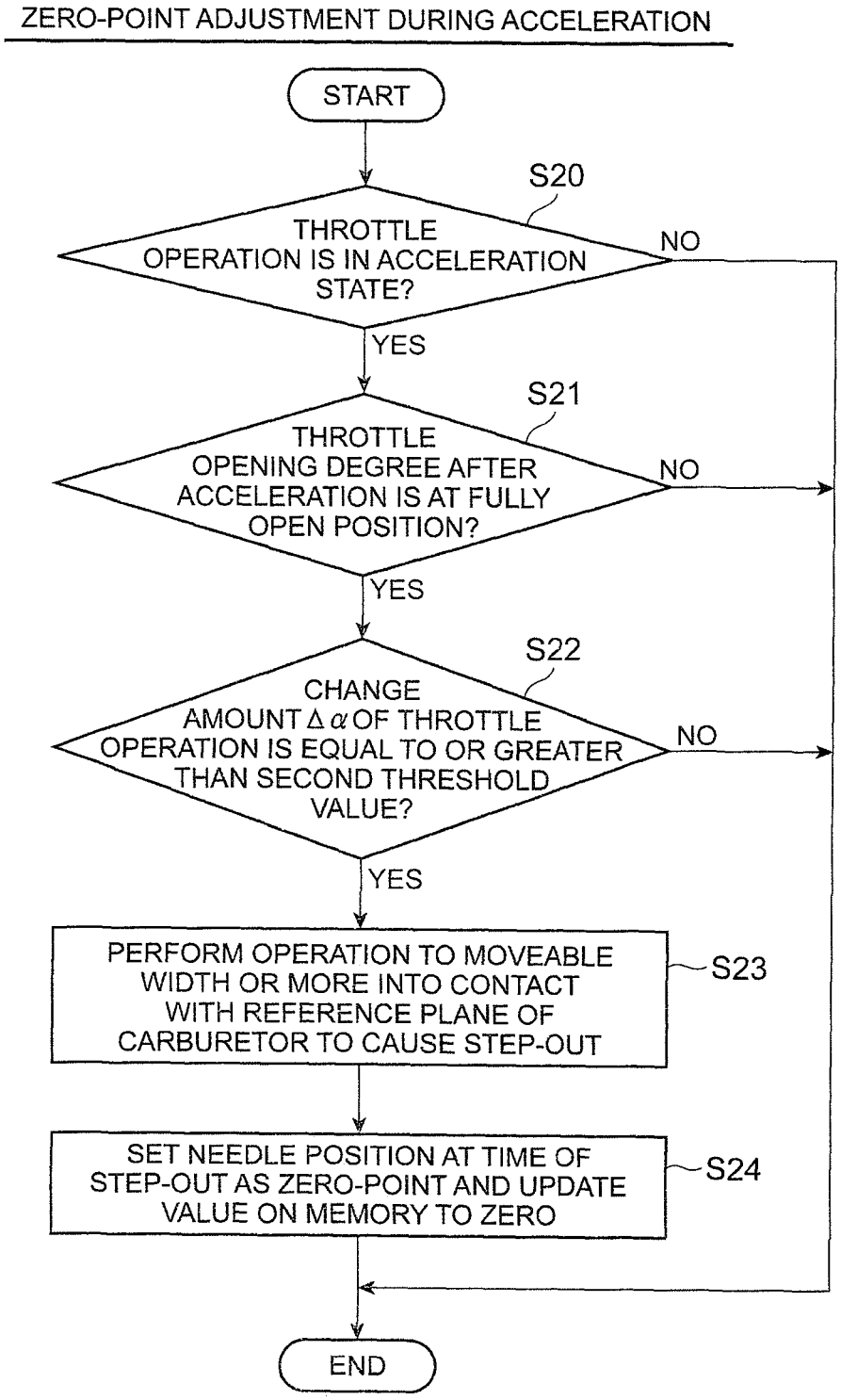
FIG. 10 shows a flowchart for explaining the other zero-point adjustment method.
Figure 11:
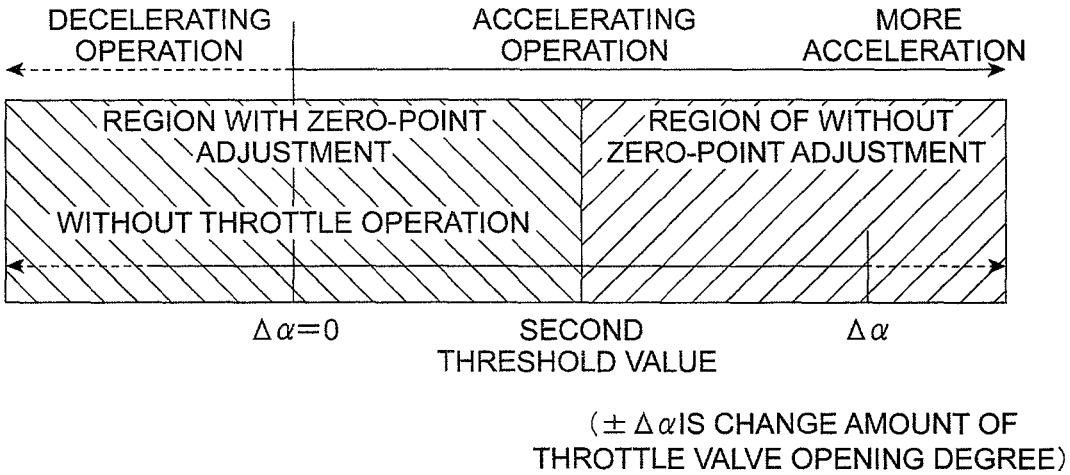
FIG. 11 shows a diagram for explaining the zero-point adjustment shown in FIG. 10 performed during acceleration.

The zero-point adjustment during acceleration will be described with reference to FIG. 10. In FIG. 10, it is determined at step S20 whether a throttle operation is in an acceleration state. This determination is made based on the output of the position sensor 26 through the control unit 34 (FIG. 1). At next step S21, it is determined whether the throttle opening degree is at the fully open position. This determination is also made based on the output of the position sensor 26. At next step S22, it is determined whether a change amount Au of the throttle operation is equal to or greater than a second threshold value. If all the steps of steps S20 to S22 are YES, it is determined that the current operation state corresponds to a region with zero-point adjustment shown in FIG. 11, and the zero-point adjustment is performed at step S23. This zero-point adjustment is performed by the method described with reference to FIG. 7. Specifically, the needle 10 is displaced upward to move the needle 10 to a position at which the needle 10 can no longer be displaced. At next step S24, the zero-point is set to the position at which the needle 10 can no longer be displaced upward, and this value on the memory 36 (FIG. 1) is updated to zero.

Regarding the arrangement of the position sensor 26 in the first and second embodiments, since the position sensor 26 is for the purpose of detecting the throttle opening degree, the arrangement position of the position sensor 26 is arbitrary as long as this purpose is achieved, as illustratively shown in FIGS. 12 to 15.

Figure 12:
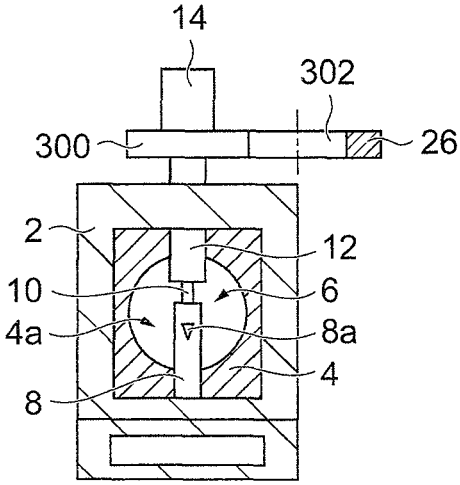
FIG. 12 shows a diagram for explaining one modification example of arrangement of a position sensor.

As shown in FIG. 12, a drive gear or drive roller 300 may be disposed on an output shaft of the electric motor 14. The position sensor 26 detects the rotation of the drive gear or drive roller 300 through an intermediate gear or roller 302 interposed between the position sensor 26 and the drive gear or drive roller 300.

Figure 13:
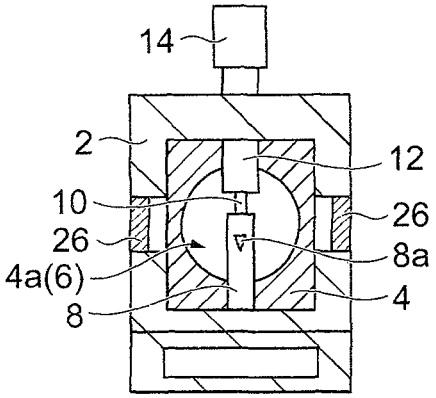
FIG. 13 shows a diagram for explaining another modification example of arrangement of the position sensor.

As shown in FIG. 13, the position sensor 26 may be attached to the carburetor main body 2, and this position sensor 26 may be arranged at a position where the rotation of the valve main body 4 can be detected.

Figure 14:
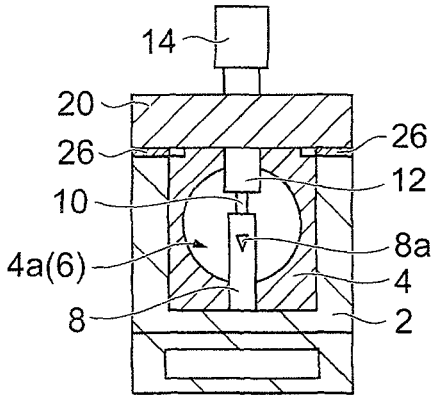
FIG. 14 shows a diagram for explaining another modification example of arrangement of the position sensor.

As shown in FIG. 14, the position sensor 26 may be disposed between the carburetor main body 2 and the cover member 20 to detect the rotation of the valve main body 4.

Figure 15:
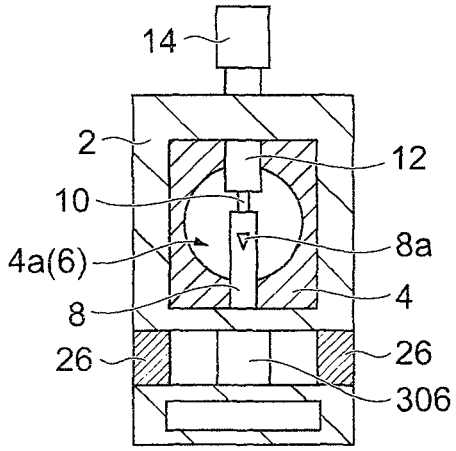
FIG. 15 shows a diagram for explaining the other modification example of arrangement of the position sensor.

As shown in FIG. 15, the valve main body 4 may be provided with a cylindrical part 306 extending downward from the lower surface thereof, and the position sensor 26 may be disposed around the cylindrical part 306.

Figure 16:
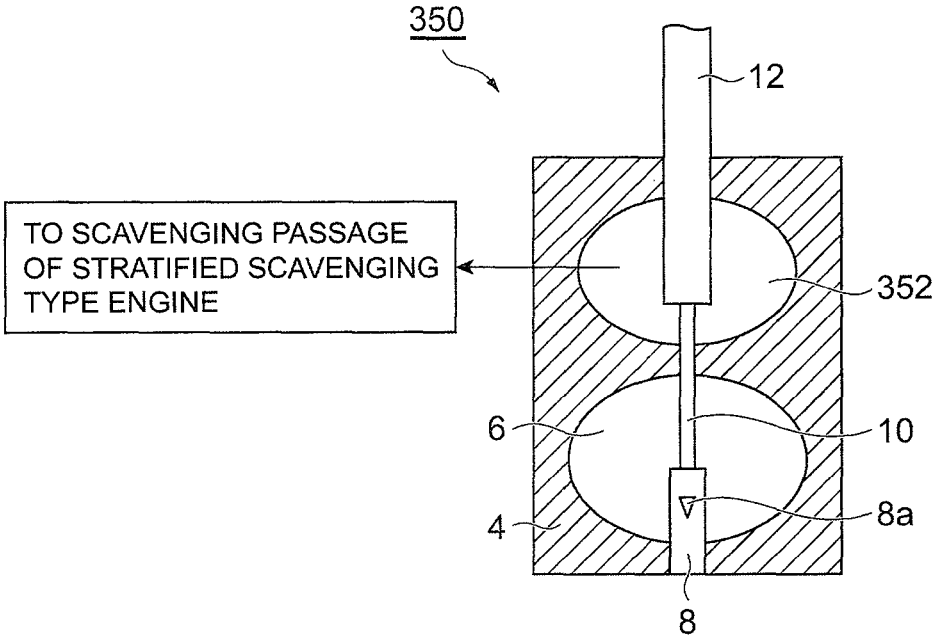
FIG. 16 shows a diagram for explaining an outline of a rotary carburetor according to the present invention preferably applicable to a stratified scavenging engine.

Although the first and second embodiments and modification examples thereof have been described, the present invention is not limited to a rotary carburetor having the one through-hole 4*a* (the intra-carburetor air-fuel mixture passage 6) in the valve main body 4. The present invention is also applicable to the stratified scavenging rotary carburetor disclosed in Patent Document 5 (U.S. Pat. No. 7,261,281 B2). FIG. 16 shows the valve main body 4 included in a stratified scavenging rotary carburetor 350 of a third embodiment. It should be understood that the other constituent elements of this stratified scavenging rotary carburetor 350 is substantially the same as the first and second embodiments. Referring to FIG. 16, the valve main body 4 has an air passage 352 in addition to the intra-carburetor air-fuel mixture passage 6. Air is supplied through this air passage 352 to a scavenging passage of a stratified scavenging engine. This scavenging passage is denoted by reference numerals 13, 14 in FIG. 2 of US 2014/0360467 A1 and U.S. Pat. No. 8,166,931 B2. In U.S. Pat. No. 8,833,316 B2, a specific configuration of the scavenging passage is disclosed in FIG. 3 (reference numeral 34). These disclosures of US 2014/0360467 A1, U.S. Pat. No. 8,166,931 B2, and U.S. Pat. No. 8,833,316 B2 are incorporated in this description. The air supplied to the scavenging passage is supplied as "leading air" to a combustion chamber of a two-stroke engine in a scavenging stroke thereof.

EXPLANATIONS OF LETTERS OR NUMERALS

100 rotary carburetor of first embodiment
200 rotary carburetor of second embodiment
350 rotary carburetor of third embodiment
2 carburetor main body
4 valve main body (rotating member)
6 intra-carburetor air-fuel mixture passage
8 nozzle
8*a* fuel discharge port
10 needle
12 drive mechanism component
14 electric motor
22 hollow throttle shaft
24 throttle lever (rotating member)
26 position sensor
34 control unit
36 memory
204*a* cam surface
300 drive gear or drive roller

What is claimed is:

1. A portable engine working machine comprising:

a rotary carburetor disposed in an intake passage of the portable engine working machine;

a rotatable valve main body received in a carburetor main body of the rotary carburetor, mechanically coupled to a throttle trigger operated by an operator, and rotated by an operation of the throttle trigger to change a throttle opening degree;

a cover member closing the carburetor main body receiving the rotatable valve main body;

a nozzle disposed on an axis of the rotatable valve main body and fixed to a carburetor main body, including a fuel discharge port supplying a fuel to an intra-carburetor air-fuel mixture passage;

a needle disposed coaxially with the nozzle and disposed with a portion inserted into the nozzle, the needle being displaced relative to the nozzle to change an effective area of the fuel discharge port so as to control an amount of a fuel discharged from the fuel discharge port;

an electric motor for displacing the needle along an axis; and a drive mechanism component fixed to the cover member and interposed between the electric motor and the needle for converting a rotational movement of the electric motor into a linear movement, wherein the rotatable valve main body is not vertically displaced when the rotatable valve main body is in rotational motion.

2. The portable engine working machine of claim 1, wherein the fuel discharge port is formed in a circumferential surface of the nozzle at a tip portion of the nozzle.

3. The portable engine working machine of claim 2, wherein the rotatable valve main body has a hollow throttle shaft extending on the axis of the rotatable valve main body, and a throttle lever coupled to the hollow throttle shaft in a relatively non-rotatable manner and mechanically coupled to the throttle trigger, and wherein the drive mechanism component is received in the throttle shaft.

4. The portable engine working machine of claim 3, further comprising a position sensor disposed to surround a rotating member rotating in conjunction with an operation of the throttle trigger, wherein a throttle opening degree is detected by the position sensor.

5. The portable engine working machine of claim 4, wherein the rotating member is the throttle lever.

6. The portable engine working machine of claim 4, wherein the rotating member is the rotatable valve main body.

7. A rotary carburetor disposed in an intake passage of a portable engine working machine comprising:

a rotatable valve main body received in a carburetor main body of the rotary carburetor, mechanically coupled to a throttle trigger operated by an operator, and rotated by an operation of the throttle trigger to change a throttle opening degree;

a cover member closing the carburetor main body receiving the rotatable valve main body;

a nozzle disposed on an axis of the rotatable valve main body and fixed to a carburetor main body, including a fuel discharge port supplying a fuel to an intra-carburetor air-fuel mixture passage;

a needle disposed coaxially with the nozzle and disposed with a portion inserted into the nozzle, the needle being displaced relative to the nozzle to change an effective area of the fuel discharge port so as to control an amount of a fuel discharged from the fuel discharge port;

an electric motor for displacing the needle along an axis; and a drive mechanism component fixed to the cover member and interposed between the electric motor and the needle for converting a rotational movement of the electric motor into a linear movement, wherein the rotatable valve main body is not vertically displaced when the rotatable valve main body is in rotational motion.

8. The portable engine working machine of claim 7, wherein the fuel discharge port is formed in a circumferential surface of the nozzle at a tip portion of the nozzle.

9. The rotary carburetor of claim 7, wherein the rotatable valve main body has a hollow throttle shaft extending on the axis of the rotatable valve main body, and a throttle lever coupled to the throttle shaft in a relatively non-rotatable manner and mechanically coupled to the throttle trigger, and wherein the drive mechanism component is received in the throttle shaft.

10. The rotary carburetor of claim 9, further comprising a position sensor disposed to surround a rotating member rotating in conjunction with an operation of the throttle trigger, wherein a throttle opening degree is detected by the position sensor.

11. The rotary carburetor of claim 10, wherein the rotating member is the throttle lever.

12. The rotary carburetor of claim 10, wherein the rotating member is the rotatable valve main body.

13. The rotary carburetor of claim 7, wherein the rotary carburetor is applied to a stratified scavenging engine, and wherein the rotatable valve main body further includes an air passage supplying air to a scavenging passage of the portable engine working machine.

* * * * *